US010041288B1

(12) United States Patent
Flood et al.

(10) Patent No.: US 10,041,288 B1
(45) Date of Patent: Aug. 7, 2018

(54) PANEL-IN-PANEL WALL SYSTEM

(71) Applicant: Jobsite Steel Manufacturing, LLC, Lenoir City, TN (US)

(72) Inventors: Patrick Flood, Arvada, CO (US); Daniel Odom, Knoxville, TN (US)

(73) Assignee: Jobsite Steel Manufacturing, LLC, Lenoir City, TN (US)

( * ) Notice: Subject to any disclaimer, the term of this patent is extended or adjusted under 35 U.S.C. 154(b) by 0 days.

(21) Appl. No.: 15/583,422

(22) Filed: May 1, 2017

Related U.S. Application Data

(60) Provisional application No. 62/331,474, filed on May 4, 2016.

(51) Int. Cl.

| | |
|---|---|
| ***E06B 1/00*** | (2006.01) |
| ***E04B 2/44*** | (2006.01) |
| ***E06B 1/18*** | (2006.01) |
| ***E04B 2/72*** | (2006.01) |
| ***E06B 1/14*** | (2006.01) |
| ***E04B 2/62*** | (2006.01) |
| ***E04B 2/02*** | (2006.01) |

(52) U.S. Cl.
CPC ..... *E06B 1/003* (2013.01); *E04B 2/02* (2013.01); *E04B 2/44* (2013.01); *E04B 2/62* (2013.01); *E04B 2/721* (2013.01); *E06B 1/14* (2013.01); *E06B 1/18* (2013.01); *E04B 2002/0202* (2013.01)

(58) Field of Classification Search
CPC ... E06B 1/003; E06B 1/18; E06B 1/14; E04B 2/44; E04B 2/02; E04B 2/62; E04B 2/721; E04B 2002/0202; E04B 2002/7462; E04B 2002/7464
See application file for complete search history.

(56) References Cited

U.S. PATENT DOCUMENTS

| | | | | |
|---|---|---|---|---|
| 3,232,018 A * | 2/1966 | MacKean | ..... | E04B 2/58 52/346 |
| 3,436,886 A | 4/1969 | Nowak et al. | | |
| 3,511,005 A | 5/1970 | MacMaster | | |

(Continued)

FOREIGN PATENT DOCUMENTS

| | | |
|---|---|---|
| EP | 0872618 A1 | 10/1998 |
| WO | 2011144941 A2 | 11/2011 |

OTHER PUBLICATIONS

C-SF13 Strong Frame Solutions, Simpson Strong-Tie, www.strongtie.com, Accessed Mar. 8, 2016.

(Continued)

*Primary Examiner* — Rodney Mintz
(74) *Attorney, Agent, or Firm* — Chambliss, Bahner & Stophel, P.C.

(57) ABSTRACT

A structural wall panel system for use in light gauge construction to form a wall with door or window openings. The system includes a structural frame defining a wall opening sized and configured to receive a wall panel. A non-structural wall panel is removably fixed within the wall opening of the structural frame. The wall panel may include at least one opening for a door or window. The wall panel is mounted within the wall opening using a plurality of catch clips. The catch clips are mounted to the structural frame and they precisely position and retain the wall panel within the wall opening of the frame.

15 Claims, 11 Drawing Sheets

(56) References Cited

U.S. PATENT DOCUMENTS 3,732,660 A * 5/1973 Byssing ..... E04B 2/7863 52/489.1
3,759,001 A * 9/1973 Judkins ..... E04B 2/7457 52/241
3,885,367 A * 5/1975 Thunberg ..... E04B 1/24 52/127.11
4,149,353 A * 4/1979 Adams ..... E04B 2/7409 52/489.1
4,854,096 A * 8/1989 Smolik ..... E04B 2/767 52/241
5,408,796 A * 4/1995 Hashimoto ..... E04B 2/7409 52/481.2
5,412,919 A 5/1995 Pellock et al.
5,689,922 A 11/1997 Daudet
5,782,047 A 7/1998 De Quesada
6,148,583 A 11/2000 Hardy
6,298,617 B1 10/2001 de Quesada
6,318,044 B1 11/2001 Campbell
6,374,551 B1 4/2002 Boilen et al.
6,418,682 B1 7/2002 Rice
6,647,691 B2 * 11/2003 Becker ..... E04B 2/7457 403/242
6,679,021 B2 1/2004 Maimon et al.
7,694,483 B1 * 4/2010 Tucker ..... E04C 3/28 52/280
7,891,155 B2 2/2011 Surowiecki
8,074,416 B2 * 12/2011 Andrews ..... E04B 2/767 403/230
8,109,056 B2 2/2012 Hashimoto et al.
8,112,956 B2 2/2012 Hashimoto et al.
8,322,102 B2 12/2012 Krieger
8,615,942 B2 12/2013 Lafreniere
8,733,044 B2 * 5/2014 Dollerup ..... E04B 2/7457 52/241
8,997,424 B1 4/2015 Miller
9,157,572 B1 * 10/2015 Merideth ..... F24F 13/32
9,238,933 B1 1/2016 Avissato
9,477,142 B1 * 10/2016 Baumgartner ..... A63J 1/02
2002/0108325 A1 8/2002 Hulls et al.
2004/0035074 A1 * 2/2004 Stanescu ..... E04B 2/7422 52/481.2
2004/0261349 A1 12/2004 Hasimoto et al.
2006/0272254 A1 * 12/2006 Hoffmann ..... E04B 2/7425 52/474
2008/0040997 A1 2/2008 Klein
2008/0196332 A1 8/2008 Surowiecki
2009/0007507 A1 1/2009 Zhai
2009/0249741 A1 10/2009 Cancian
2009/0272051 A1 * 11/2009 Sipe ..... E04B 1/08 52/210
2010/0083606 A1 4/2010 Davis et al.
2010/0236185 A1 9/2010 Hashimoto et al.
2012/0246939 A1 * 10/2012 Odom ..... E04C 3/17 29/897.32
2013/0276394 A1 10/2013 Winfield
2014/0245674 A1 9/2014 Harrison et al.
2015/0204068 A1 7/2015 Miller
2015/0322668 A1 11/2015 Quinn et al.
2016/0032587 A1 2/2016 Michaud et al.
2017/0065902 A1 * 3/2017 Maxam ..... A63J 1/02
2017/0342736 A1 * 11/2017 Roshinsky ..... E04B 2/767

OTHER PUBLICATIONS

Design Engineering and Exterior Light-Gauge Steel Framing Basics, Ron Black & Associates, Inc., 2009, www.clarkdietrich.com, Accessed Mar. 2, 2016.
HTH-CV_10, hftps://buildingdata.energy.gov, Accessed Mar. 4, 2016.
Hydraulic Installation Guide, Schweiss, https://www.bifold.com/hydraulic-installation-warranty.php, Accessed Mar. 2, 2016.
Kelly Klosure Systems Technical Guide, Kelly Klosure, www.kellyklosure.com, Accessed Mar. 4, 2016.
Hardy Frame Moment Frame, Hardy Frame Shear Wall System, http://www.hardyframe.com/HF/momenfframe/momentframe.html, Accessed Mar. 4, 2016.
Paco Steel and Engineering General Catalog, 2008.
StiffWall—Shear Wall System, TSN Product, http://www.steelnetwork.com/Products/StiffWall, Accessed Mar. 2, 2016.
Wind Bracing Publication, Fairfax County, Virginia, Mar. 29, 2012.
ClarkDietrich RedHeader RO Rough Opening System video, published Jan. 30, 2012, https://youtu.be/jgKxOQauzw.

* cited by examiner

PANEL-IN-PANEL WALL SYSTEM

CROSS-REFERENCE TO RELATED APPLICATION

This application claims the benefit of U.S. Provisional Application No. 62/331,474, entitled Panel-in-Panel Wall System, filed May 4, 2016, which is hereby incorporated by reference in its entirety.

FIELD

This disclosure relates to the field of wall panels in light frame construction. More particularly, this disclosure relates to a structural frame that forms a wall panel opening for receiving a wall panel and a non-structural wall panel that may include a door or window opening and that is removably placed within the wall panel opening of the frame.

BACKGROUND

Often an architect or builder does not decide on the exact size or placement of openings in the structure (e.g., door or window openings) until well into the construction process. Also, the size or placement of a door or window might be changed from its original design during the construction process. According to traditional construction methods, changing the size or placement of a door or window after the wall has been installed is a time consuming and expensive process. Another common issue with prior light gauge metal construction methods is that placing wall panels into position can be a slow, time consuming and dangerous process. Often, several workers are needed for this process to hold the wall panel, position the wall panel correctly as it is being held, and then secure the wall panel. Another issue is that traditional structural members are not precisely dimensioned and the dimensions of the members, such as the width of the flanges of an I-beam, may vary from one member to the next. When used in the construction of walls, this lack of consistency may cause imperfect wall surfaces. For example, the wall surface may become visibly wavy due to the changes in dimensions in the structural members.

What is needed is a system and method that addresses the issues mentioned above.

SUMMARY

The above and other needs are met by a panel system that is precisely dimensioned so that the resulting wall has very little deviation across its surface, including between different types of panels, such that surface imperfections are minimized. In another aspect, this invention provides a method for installing wall panels in the wall quickly and easily using a location and retention clip or catch clip mechanism that holds and correctly positions the wall panels. In another aspect, this invention provides a method for providing rough wall openings for later-installed door and window panels that are structurally sound. Each of these aspects is discussed in detail below.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
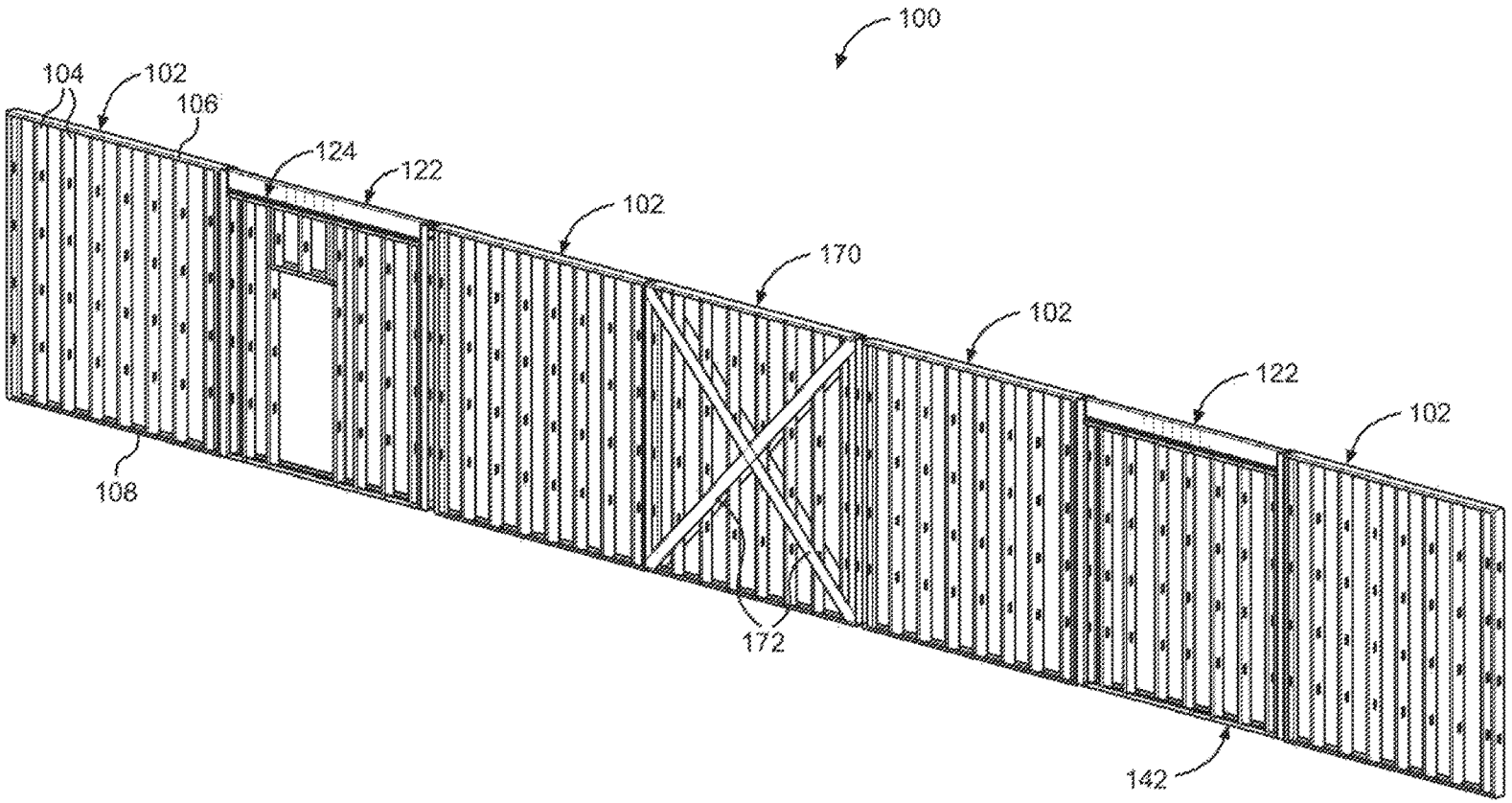
FIG. 1 is a perspective view depicting a wall having various wall panel sections, including structural and non-structural sections, according to an embodiment of the present disclosure.

With initial reference to FIG. 1, there is shown a structural wall system 100 for use in light gauge construction according to an embodiment of the present invention. The system 100 utilizes a combination of several different types of wall panels. The type of panel selected depends on the particular needs of the wall, including whether a structural or non-structural wall is needed, whether a door or window is needed, whether wind-resistance is needed, etc.

First, the system 100 includes a standard light gauge metal wall panel 102. This type of wall panel 102 includes a series of vertical metal studs 104 that are placed within and secured to an upper tray 106 and a lower tray 108. Often, these types of wall panels 102 do not include openings for doors or windows. For this reason, they are inexpensive compared to other types of wall panels and are simple and quick to manufacture. As such, these types of stud-only wall panels 102 are used as much as possible in framing a typical building.

Next, when a door or window is required, a panel 124 having openings for the door or window is used. A side-by-side comparison of the panel 124 against a traditional door or window panel 110 is provided in FIGS. 2 and 3. Tradition panels 110 are typically designed and constructed before they are brought to the construction site. This requires advance knowledge of the size and placement of the door or window opening 112. The panels 110 are then mounted in the planned location. In order to change the size or location of the door or window, the entire wall panel 110 is typically removed and replaced. This may be very difficult at later stages in the construction, especially if the wall is a structural wall that cannot be removed easily. In that case, removing the door or window panel 110 may require special bracing, etc. in order to hold the building up while the wall panel is replaced.

Figure 2:
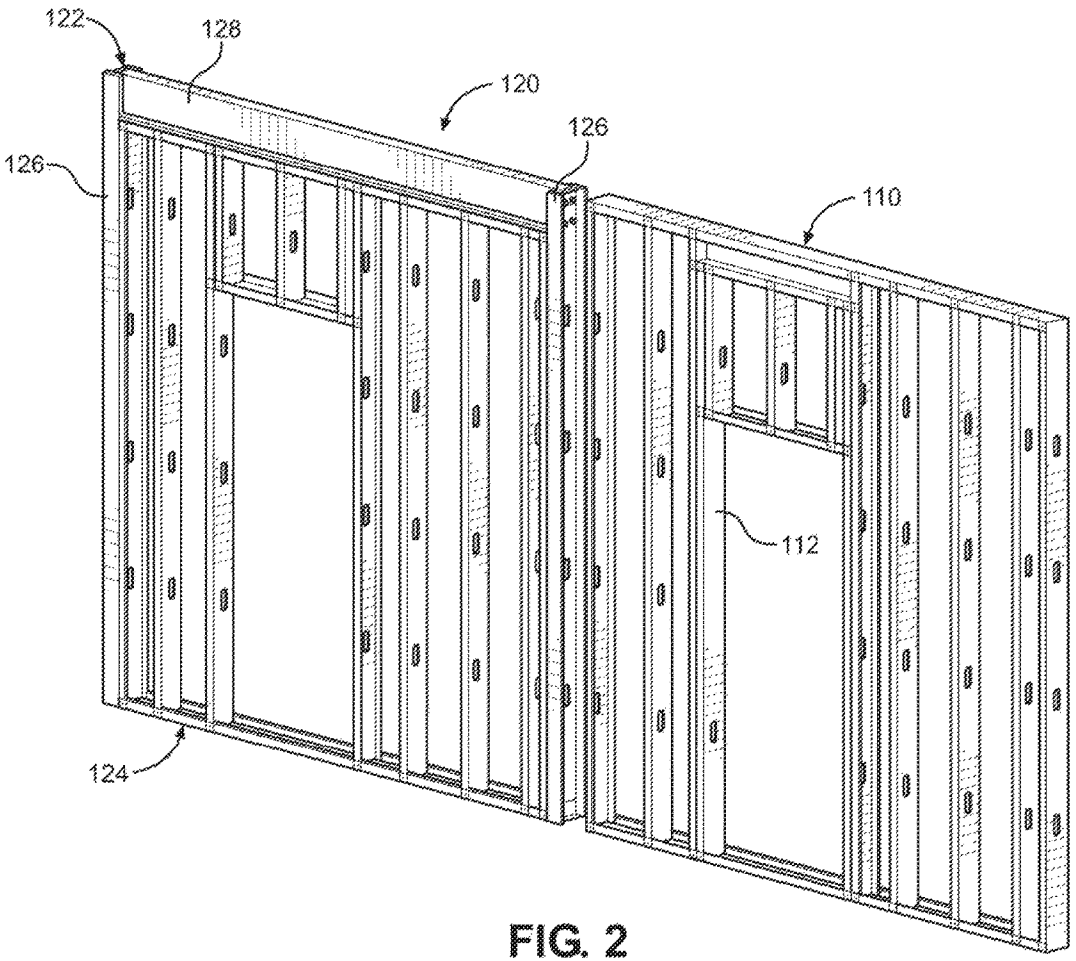
FIG. 2 is a perspective view of a structural and non-structural wall panel having a door opening.
Figure 3:
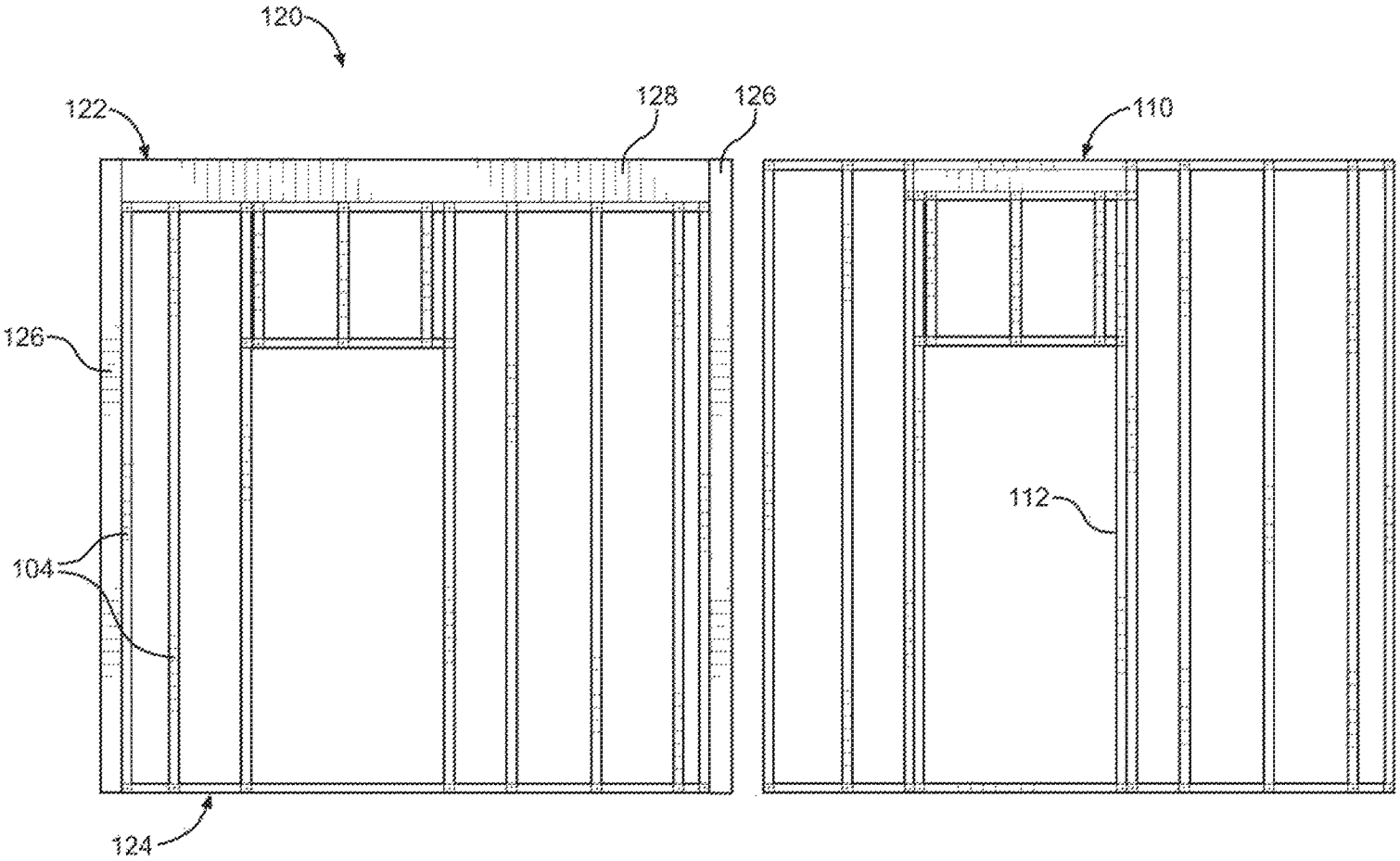
FIG. 3 is a front view of the structural and non-structural wall panels of the FIG. 2.

However, in the present wall system 100, traditional door or wall panels 110 may be replaced by the panel-in-panel wall section 120, which is also shown in FIGS. 2 and 3. These wall panel sections 120 are used wherever a door or window is required in place of the traditional wall panels 110. The panel-in-panel wall section 120 includes a U-shaped structural frame 122 formed by a plurality of framing members and a wall panel section 124 that is removably installed within the frame. In the discussion that follows, this will be called a "Type I" panel.

Figure 4:
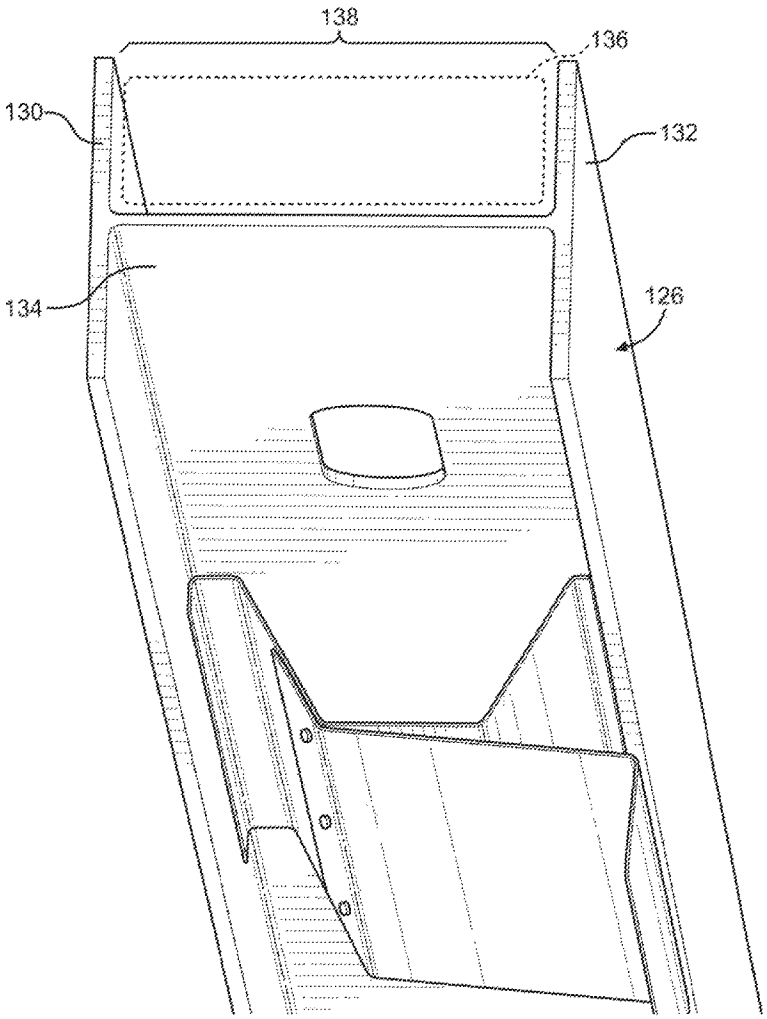
FIG. 4 is a perspective view depicting a vertical column of a structural frame and a catch clip according to an embodiment of the present disclosure.
Figure 5:
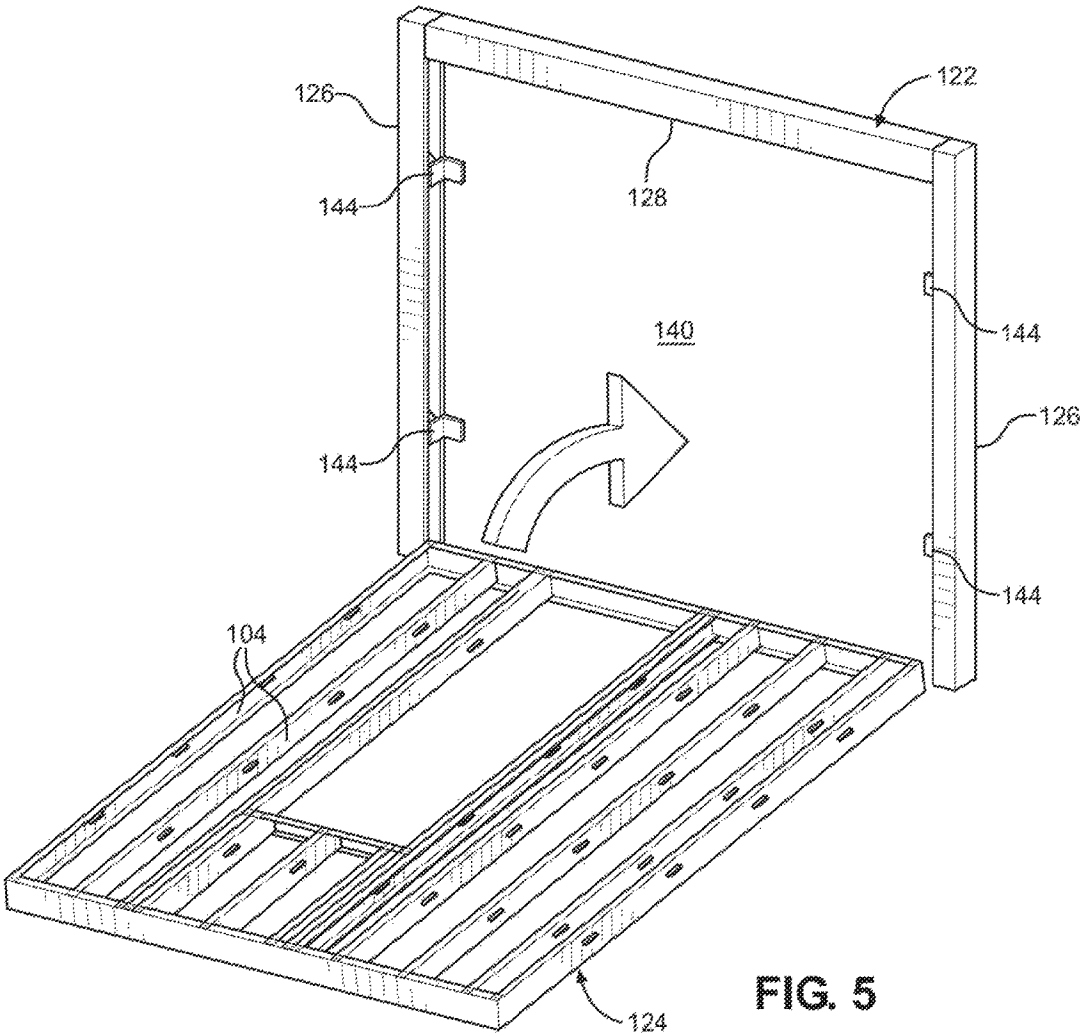
FIG. 5 is a perspective view depicting a wall panel being installed within a structural frame.
Figure 6:
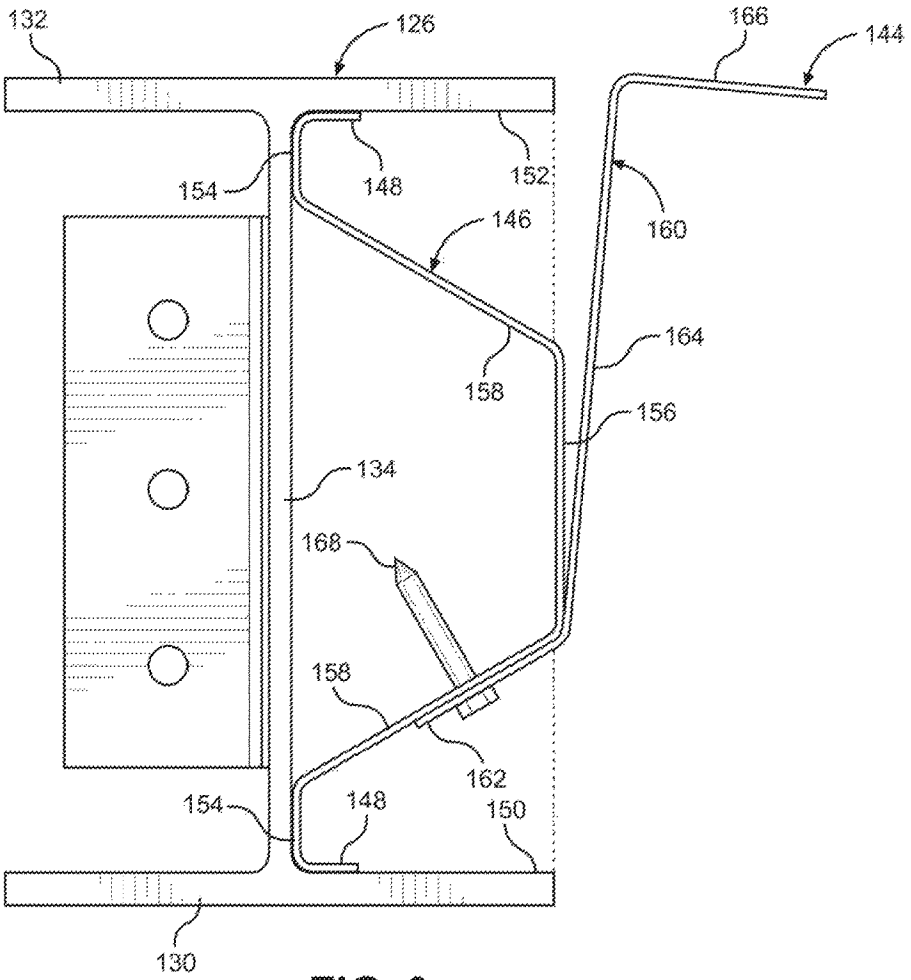
FIGS. 6-9 are plan views depicting a wall panel being installed next to a vertical column of a structural frame with a catch clip according to an embodiment of the present disclosure.

The outer U-shaped frame 122 of the Type I panel 120 includes two structural vertical columns 126 and a structural horizontal header 128 mounted between the columns. As shown in FIG. 4, each of the vertical columns 126 has an inner flange 130 that is located on the inward-facing side of the wall. Additionally, the columns 126 have an outer flange 132 that is parallel with the inner flange 130 and that is located on the outward-facing side of the wall. At least one web 134 extends between the inner flange 130 and outer flange 132. A web area 136 is defined by the inner flange 130, outer flange 132 and web 134. The web area 136 includes an open face 138 opposite from the web 134. Thus, a suitable column may be an I-shaped, U-shaped, or H-shaped column. As shown in FIG. 5, the header 128 is mounted between the columns 126 to form the U-shaped structural frame 122 and opening 140. The wall opening 140 is sized and configured to receive the wall panel 124.

As shown in FIG. 1, another version of the Type I panel is a non-structural stud-only panel 142, which may also be mounted within the structural frame 122. This stud-only panel 142 is similar to the panel 102 described above. The primary difference is that panel 142 is installed within the structural U-shaped frame 122 the combination and can function as a structural wall section.

As illustrated in FIG. 5, wall panel 124 (or panel 142) is removably located within the structural frame 122 and held in place by a plurality of catch clips 144, which are installed in the web area 136 of the vertical frame members 126. In addition to holding the wall panel 124 in place, the clips 144 also precisely position the wall panel 124 within the wall opening 140 of the frame 122 between the inner flange 130 and the outer flange 132. The process for installing a catch clip 144 within the web area 136 of the vertical frame members 126 and positioning a correctly positioning a panel 124 using the catch clip is shown in FIGS. 5-9.

The catch clip 144 is provided in two separable parts. It includes a continuous first clip member 146 having an M-shaped profile that is formed out of a sheet material with a plurality of bends. The first clip member 146 is mounted in the web area 136 of the vertical framing members 126 between the inner flange 130 and the outer flange 132. This portion of the catch clip may be pre-installed before the columns are taken to the building location or panel assembly area in order to save time during construction. Far left and right contact surfaces 148 of the first clip member 146 contact inside surfaces 150, 152 of the inner and outer flanges 130, 132, which prevents the catch clip from moving left or right. A rear contact surface 154 contacts the web 134 of the structural member 126 and determines the positioning of the first clip member 146 with respect to the web and the open face 138 of the structural member. A middle contact surface 156 is located between the left and right contact edges 148. Sloping side surfaces 158 connect each of the left and right contact edges 148 to the middle contact surface 156. The sloping side surfaces 158 cause the middle contact surface 156 to be spaced apart from and to extend parallel with the web 134 of the structural frame member 126. Preferably, the rear contact surfaces 154 are positioned such that the middle contact surface 156 of the first clip member 146 is flush with the ends of the outer flanges 130, 132, as shown by dashed lines in FIG. 6.

The catch clip 144 also includes a continuous second clip member 160 having a Z-shaped profile that is formed out of a sheet material with a plurality of bends. The second clip member 160 includes a connection end 162 mounted to one of the sloping side surfaces 158 of the first clip member 146. The second clip member 160 also includes a middle contact surface 164 that is flexibly mounted to the connection end 162. Lastly, the second clip member 160 includes a wall panel support end 166 that extends substantially perpendicularly away from the middle contact surface 164 in a direction opposite from the connection end 162. Thus, the wall panel support end 166 extends outwards away from the vertical column 126 when the second clip member 160 is mounted to the first clip member 146. The second clip member 160 may be mounted to the first clip member 146 at the construction site in order to avoid damaging the second clip member during transit. In particular, a connector 168 is inserted through the connection end 162 of the second clip member 160 and through the sloping side surface 158 of the first clip member 146 in order to connect the two together.

Figure 7:
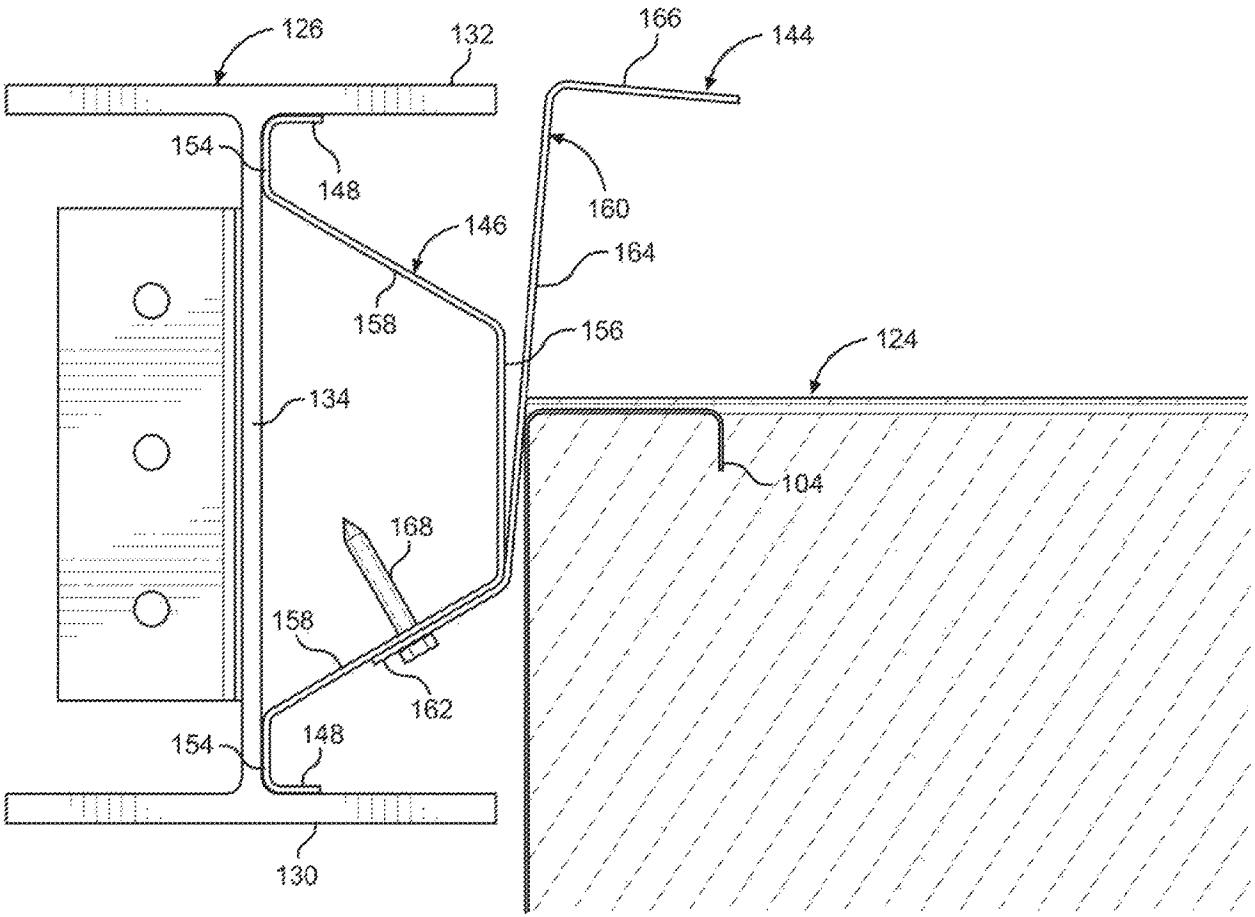
Figure 8:
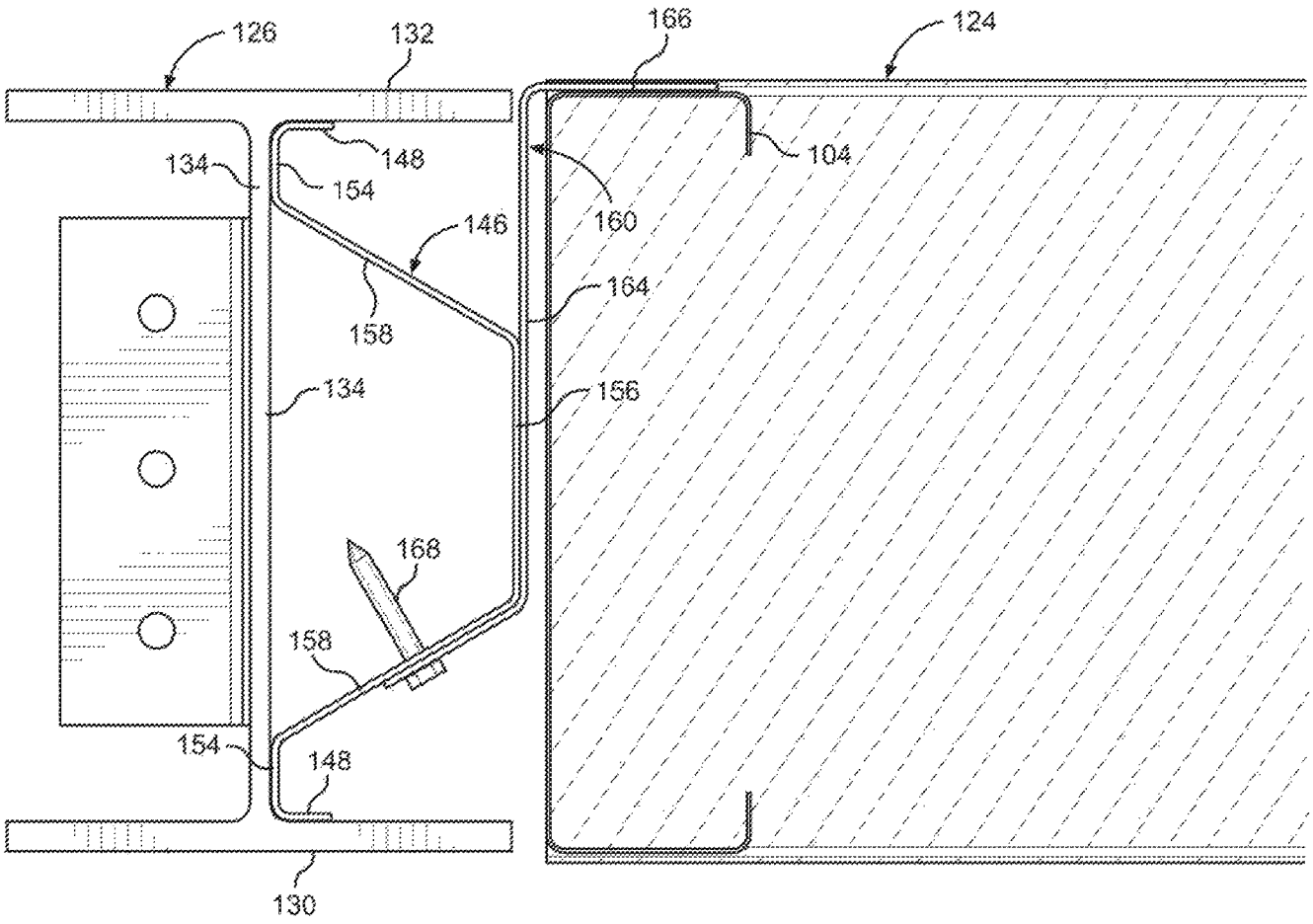
Figure 9:
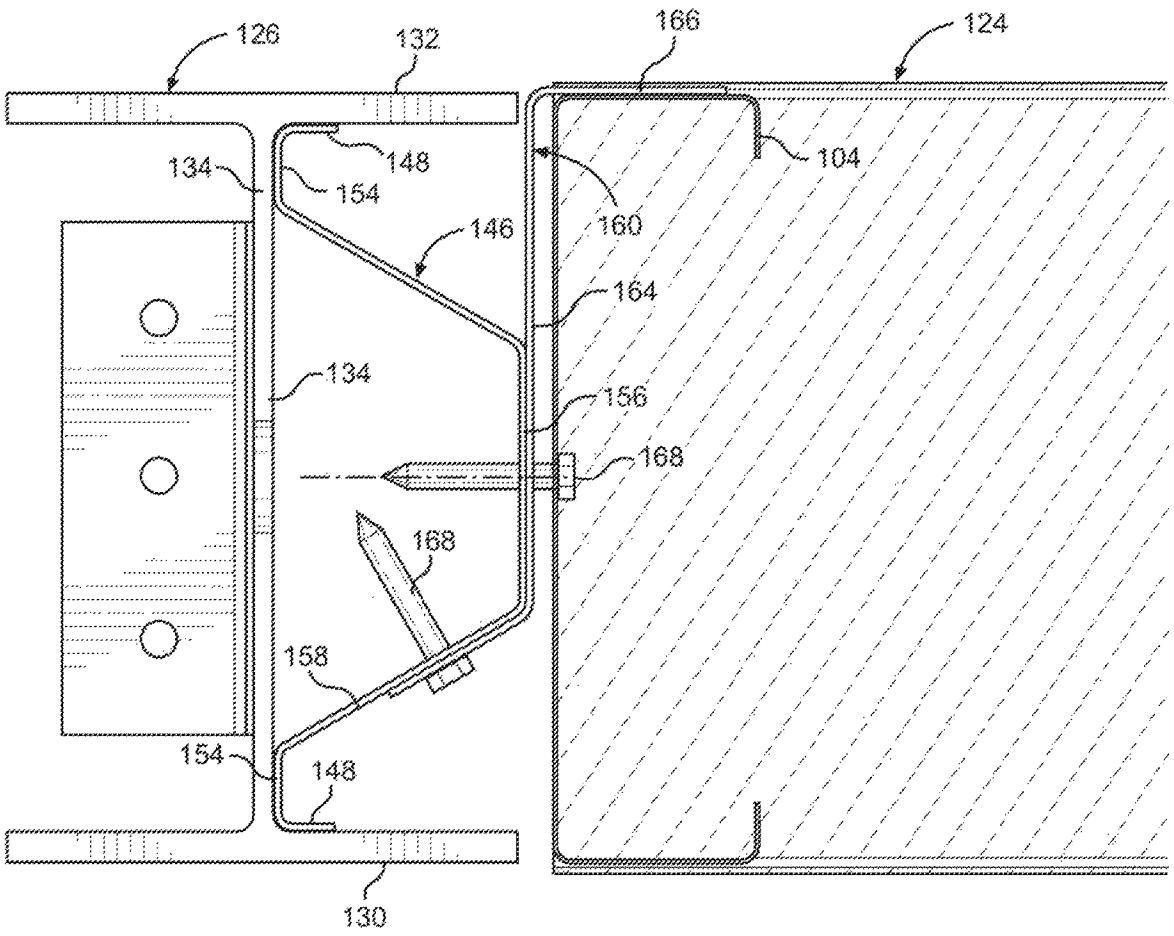

As shown in FIGS. 7-9, the middle contact surface 164 of the second clip member 160 is configured to move between an un-flexed position where middle contact surface of the second clip member is not substantially parallel with the middle contact surface 156 of the first clip member 146 and a flexed position where the middle contact surface of the second clip member is substantially parallel with the middle contact surface of the first clip member. After the second clip member 160 is mounted to the first clip member 146, inserting a wall panel 124 into the frame opening 140 causes the second clip member to flex outward and to move from the un-flexed position to the flexed position. As shown in FIG. 8, the wall panel 124 eventually contacts the wall panel support end 166, whereupon it is automatically correctly positioned with respect to the inner flange 130 and outer flange 132.

As shown in FIG. 9, once the second clip member 160 flexes outward from the un-flexed position to the flexed position, another connector 168 is inserted through the final stud 104 of the panel 124 nearest the catch clip 144. The connector 168 passes through the middle contact surface 164 of the second clip member 160 and then through the middle contact surface 156 of the first clip member 146, thereby connecting the panel 124 to the catch clip 144. Following this procedure, the wall panel 124 is correctly located within the opening 140, both in a left-to-right direction and in a front-to-back direction. The panel may be easily removed and exchanged by removing the connectors 168.

An advantage of the present design is that the structural frame 122 may be installed well before the window or door wall panel 124 is designed, built or constructed. This allows construction to take place much more quickly and for the framing to begin much earlier than is currently possible. Once the size and placement of the door or window is finalized, the wall panel with the door or window is built and installed. Another advantage of the current design is that the wall panels 124 may be easily removed and replaced without impacting the structural integrity of the overall structure. In some cases, a door or window may have been located in the wrong location and it must be corrected. The old, incorrect panel may be easily removed and replaced with the correct panel. Alternatively, in certain embodiments, the window or door panel may be modified in the field and then re-installed with the door or window located in a new location.

Figure 10:
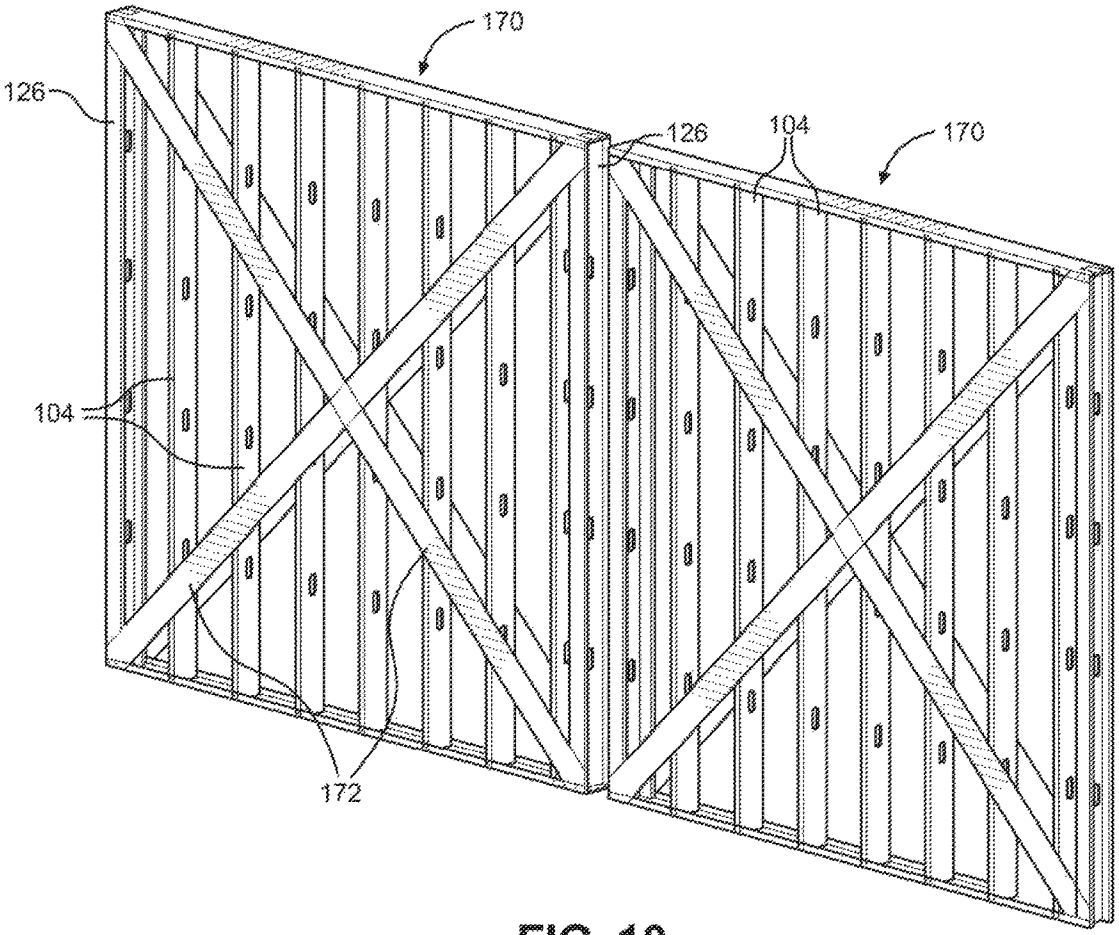
FIG. 10 is a perspective view of a wall panel having cross bracing and structural columns forming ends of the wall panel.
Figure 11:
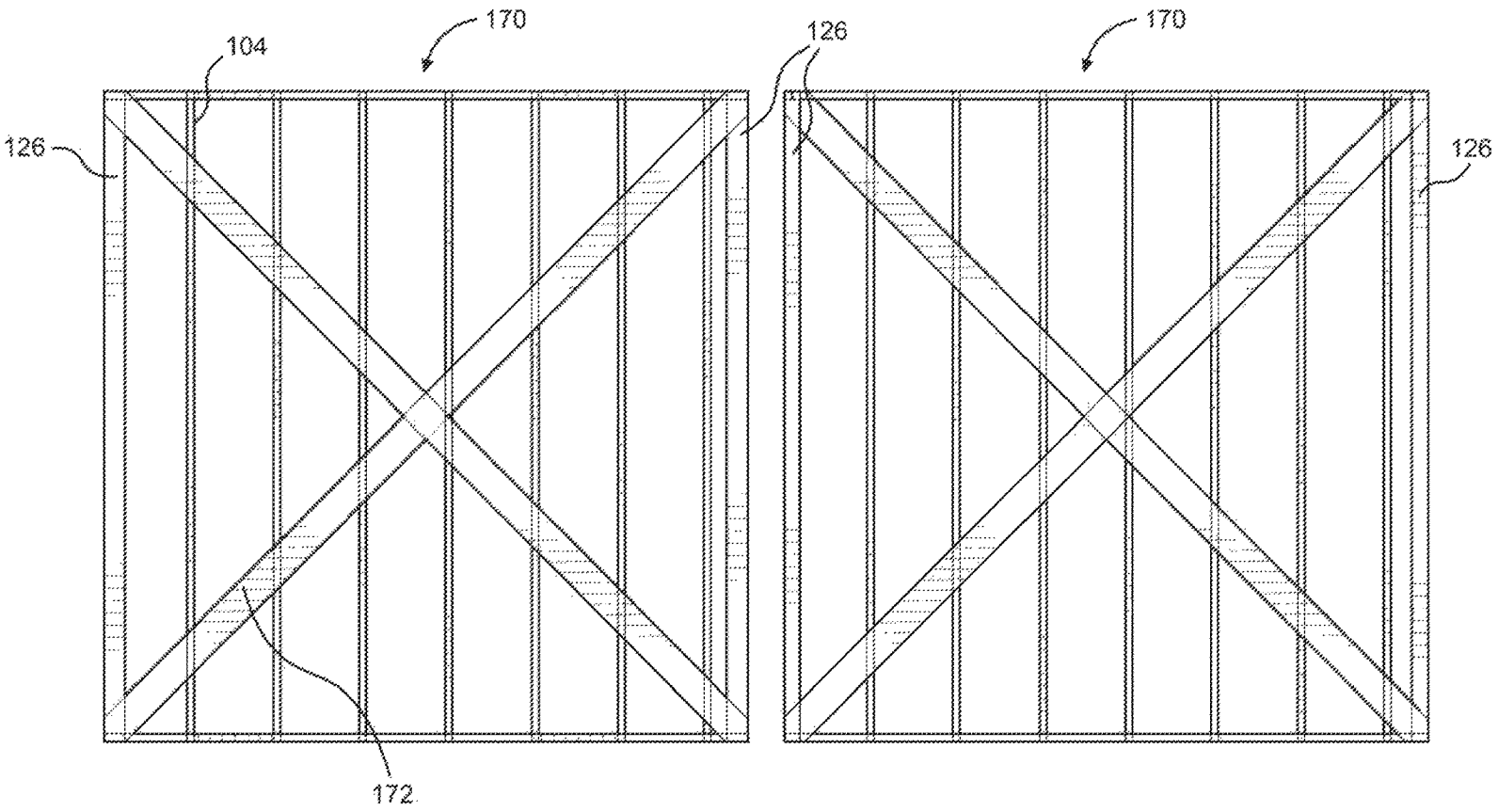
FIG. 11 is a front view of a wall panel having cross bracing and structural columns forming ends of the wall panel.

In other embodiments, such as that shown in FIGS. 10 and 11, the system may include a reinforced wall panel having columns 126 located on the left and right ends of metal studs and without a header. In the discussion that follows, this will be called a "Type II" panel 170. In a type II panel, the columns 126 may be formed as part of the wall panel 170, as depicted here, or the columns may be independent of the wall panel. In that case, as traditional stud-only panel 102 may be installed between the columns 126 (i.e., columns 126 are located along left and right outside ends of panel 102). The panels may also optionally include cross bracing 172 to assist in withstanding shear stress loads.

Referring back to FIG. 1, the various panel types may be combined in various combinations in a single wall section or wall system 100, based on the needs of the building and the site conditions. For example, a Type I panel may be placed wherever a door or window is needed. As mentioned earlier, an advantage of the Type I panel is that it allows a rough opening for the door or window to be provided in a section of a wall even though the final placement and positioning has not been determined. This would enable the design of the wall to be finalized much later than is currently possible and for it to be easily changed as needed. Alternatively, a Type I panel may be used simply to provide additional support without placing a door or window. The standard stud wall 102 may be used in other locations in the wall where added support is not necessary in order to reduce costs of the project.

The wall panels discussed above are comprised of a plurality of vertical metal studs mounted between upper and lower horizontal trays. It includes an inner wall surface located proximate the inward facing surface of the wall and an outer wall surface located proximate the outward facing surface of the wall. As discussed below, to avoid having imperfect (wavy) walls, it is important to align the inner wall surface with the inside of the structural frame and the outer wall surface with the outside of the structural frame. This has typically been a difficult task to accomplish but the catch clip simplifies this task, as discussed below.

These frame members 126, 128 are precisely dimensioned in order to avoid the imperfections discussed above. While standard structural members are often dimensionally accurate to ±⅛, the present system demands a higher level of dimensional accuracy. In some embodiments, the structural members 126, 128 are accurate to within ±⅛ of an inch. In other embodiments, the dimensions are accurate to within ±1/16 of an inch. Additionally, structural members can tolerate approximately ⅛ of an inch of curvature or twist in any 10-foot section. This degree of accuracy is attained due to the construction methods used. A suitable frame 122 may be constructed using a variety of methods. For example, cold-formed steel sheets may be cut very precisely to the required dimensions and then welded together to form the columns 126 and header portions 128 of the frame 122. In other embodiments, a suitable frame 122 may be formed using hot rolled steel that is precisely formed to meet the required tolerances.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A structural wall panel system for use in light gauge construction, the system comprising:

a structural frame defining a wall opening sized and configured to receive a non-structural wall, the structural frame comprising:

a pair of vertical columns that are spaced apart laterally and aligned longitudinally, each vertical column having an inward-facing outer surface, an outward-facing outer surface, and a space separating the inward-facing outer surface from the outward-facing outer surface; and a horizontal header mounted between the columns;

the non-structural wall having an inward-facing outer surface and an outward-facing outer surface, wherein the wall is removably fixed within the wall opening of the structural frame and is positioned such that the inward-facing outer surfaces of the frame and the wall are co-planar, the outward-facing outer surfaces of the frame and the wall are co-planar, and the wall fills across the space separating the inward-facing outer surface of the frame and the outward-facing outer surface of the frame; and a plurality of catch clips engaging the structural frame and configured to position and retain the wall within the wall opening of the frame in a longitudinal direction such that the inward-facing outer surfaces of the frame and the wall are co-planar and the outward-facing outer surfaces of the frame and the wall are co-planar.

2. The system of claim 1 wherein bottom ends of the columns are mounted directly to a ground surface.

3. The system of claim 1 wherein the wall comprises a plurality of vertical metal studs mounted between upper and lower horizontal trays to form an inner wall surface located proximate an inward facing surface of the wall and an outer wall surface located proximate an outward facing surface of the wall.

4. The system of claim 1 wherein the wall comprises at least one opening for a door or window.

5. The system of claim 1 wherein the wall comprises cross bracing.

6. The system of claim 1 wherein the inward-facing outer surface of each of the columns comprises an inner flange and the outward-facing outer surface of each of the columns comprises an outer flange that is parallel with the inner flange, and wherein a width of the space is defined by a web extending between the inner and outer flanges that forms a web area, including an open face opposite the web extending across the web area.

7. The system of claim 6 wherein the plurality of catch clips having a first portion that mounts each catch clip within the web area of a respective said vertical column between the inner and outer flanges and a second portion that extends out of the web area and contacts the wall, the catch clips being configured to position and retain the wall within the wall opening of the frame.

8. The system of claim 7 wherein the first portion of each of the catch clips is a continuous first clip member having an M-shaped profile; and the second portion of the catch clip is a continuous second clip member having a Z-shaped profile, wherein the first clip member is removably connected to the second clip member.

9. The system of claim 8 wherein the first clip member has:

left and right contact edges for contacting an inside surface of inner and outer flanges and configured to prevent the first clip member from moving left or right;

a rear contact surface for contacting the web to correctly locate the first clip member at a desired depth within the web area;

a middle contact surface disposed between the left and right contact edges and spaced apart from and extending parallel with the web; and sloping side surfaces connecting each of the left and right contact edges to the middle contact surface.

10. The system of claim 9 wherein the middle contact surface extends partially across the open face of the web area when the rear contact surface is in contact with the web.

11. The system of claim 9 wherein the second clip member is mounted to the sloping side surface of the first clip member nearest the inner flange of the column.

12. The system of claim 8 wherein the second clip member has:

a connection end configured to removably mount to the first clip member;

a middle contact surface that is flexibly mounted to the connection end; and a wall support end mounted to the middle contact surface and extending in a direction opposite from the connection end.

13. The system of claim 12 wherein the wall support end extends substantially perpendicularly away from the middle contact surface such that the wall contacts the middle contact surface and wall support end when the wall is installed.

14. The system of claim 12 wherein the second clip member is configured to flex between an un-flexed position where middle contact is not substantially parallel with the middle contact surface of the first clip member and a flexed position where the middle contact surface is substantially parallel with the middle contact surface of the first clip member.

15. A method of installing a light gauge wall system having a door or window opening, the method comprising the steps of:

installing a U-shaped structural frame in a location where a non-structural wall having the door or window opening is to be located, the structural frame being formed by a plurality of framing members and including two vertical columns and a horizontal header mounted between the columns, each column having an inner flange that is located proximate an inward-facing outer surface of the wall and an outer flange that is parallel with the inner flange and that is located proximate an outward-facing outer surface of the wall and a web extending between the inner and outer flanges forming a web area, the structural frame forming a wall opening sized and configured to receive the non-structural wall;

inserting a plurality of first clip members of a plurality of two-piece catch clips into the web area of the framing members between the inner and outer flanges, where each of the plurality of first clip members is continuous and has a M-shaped profile formed by bends and further includes left and right contact edges for contacting a surface of the web area, including a first contact surface for contacting and exerting pressure on the outer flanges to hold the first clip member within the web area and a second contact surface for contacting the web to locate the first clip member at a desired depth within the web area; a middle contact surface disposed between the left and right contact edges and spaced apart from and extending parallel with the web of the structural frame such that the middle contact surface is located at an end of the outer flanges; and sloping side surfaces connecting each of the left and right contact edges to the middle contact surface;

attaching a plurality of second clip members to each of the plurality of first clip members using connectors, where each of the plurality of second clip members is continuous and has a Z-shaped profile formed by bends and further includes a connection end mounted to a respective said sloping side surface of the first clip member; a middle contact surface flexibly mounted to the connection end and configured to move between an unflexed position where the middle contact surface of the second clip member is not substantially parallel with the middle contact surface of the first clip member and a flexed position where the middle contact surface of the second clip member is substantially parallel with the middle contact surface of the first clip member; and a wall support end extending substantially perpendicularly away from the middle contact surface in a direction opposite form the connection end, the wall support end configured to contact the non-structural wall and to position the non-structural wall within the structural frame;

providing the non-structural wall having the inward-facing outer surface and the outward-facing outer surface that is formed by a plurality of vertical metal studs mounted between upper and lower horizontal trays and that includes the door or window opening;

installing the wall in the wall opening of the structural frame such that the wall contacts and exerts pressure on the plurality of second clip member to cause the middle contact surface of each of the second clip members to move to the flexed position such that the wall is held in place within the wall opening by the plurality of catch clips and wherein the wall is positioned and removably fixed within the wall opening by contacting the wall support end of each of the plurality of catch clips such that the inward-facing outer surfaces of the frame and the wall are co-planar, the outward-facing outer surfaces of the frame and the wall are co-planar, and the wall fills a space separating the inward-facing outer surface of the frame and the outward-facing outer surface of the frame;

attaching the wall to the plurality second clip members using connectors; and installing a door or window in the door or window opening located in the wall.

* * * * *